US005170505A

United States Patent [19]

Rohrer

[11] Patent Number: 5,170,505

[45] Date of Patent: Dec. 15, 1992

[54] EXPANDABLE CHILDREN'S CLOTHING

[76] Inventor: Nancy D. Rohrer, 15488 Tuxedo Dr., Plymouth, Ind. 46563

[21] Appl. No.: 791,569

[22] Filed: Nov. 12, 1991

[51] Int. Cl.[5] ..... A41D 1/00

[52] U.S. Cl. ..... 2/69; 2/70; 2/78 B; 2/126; 2/218; 2/219; 2/235; 2/269; 2/270

[58] Field of Search ..... 2/69, 70, 49 R, 76, 2/78 B, 126, 141 R, 141 A, 218, 219, 221, 235, 237, 269, 270

[56] References Cited

U.S. PATENT DOCUMENTS

| | | | |
|---|---|---|---|
| 1,066,713 | 7/1913 | Cronin | 2/126 |
| 1,089,999 | 3/1914 | Watts | 2/126 |
| 1,902,268 | 3/1933 | Scherer | 2/78 B |
| 3,116,491 | 1/1964 | Previdi et al. | 2/76 |
| 3,230,545 | 1/1966 | Galley | 2/76 |
| 4,068,316 | 1/1978 | Haywood | 2/126 |
| 4,745,634 | 5/1988 | Douez | 2/69 |
| 4,939,794 | 7/1990 | Aronson | 2/128 |

*Primary Examiner*—Werner H. Schroeder
*Assistant Examiner*—Gloria Hale
*Attorney, Agent, or Firm*—Woodard, Emhardt, Naughton, Moriarty & McNett

[57] ABSTRACT

An adjustable children's garment is provided that utilizes hook and loop type connections for adjustments. There is also provided an adjustable connection for garments that includes three flaps. The second flap may be adjustably or removably connected to the first flap and a third, cover flap may be connected over the first and second flap to protect the hook and loop connection. The three flap a arrangement provides for a more secure fastener.

10 Claims, 3 Drawing Sheets

EXPANDABLE CHILDREN'S CLOTHING

BACKGROUND OF THE INVENTION

The present invention relates generally to garments and more particularly to garments that are adjustable to accommodate various human growth periods.

One of the most expensive aspects of child rearing is providing clothing for children as they progress through various human growth periods. The life expectancy of children's wear is usually not dictated by durability but by the length of time the clothing can comfortably fit the child. Presently the only practical way to extend the useable life of children's clothing is to "hand down" the clothing to younger children.

Another shortcoming of children's wear is that it is usually designated by sizes corresponding to the ages of children. Children's heights and weights can vary drastically, however, even among children of the same age. It is desirable therefore to provide for children's wear that can be adjusted to fit the needs of each individual child.

One means for providing easy adjustment in clothing is the use of hook and loop or VELCRO type material. U.S. Pat. No. 4,677,699 to Barabe discloses a waistband adjustment for an adult garment. Barabe uses flexible VELCRO strips on the waistband of garments to accommodate small increases and decreases in waist size due to weight gain or loss.

Likewise U.S. Pat. No. 4,985,936 to Jones discloses an adjustment for adult garments. The adjustment mechanism consists of VELCRO strips placed on the insides of the lower portion of the legs of formal wear pants to accommodate small changes in the length of trousers for adult men's formal wear.

U.S. Pat. No. 4,051,854 to Aaron discloses diaper panties for babies. The diapers use a hook and loop type of arrangement to secure the diaper about the baby. This arrangement gives limited flexibility to accommodate adjustments for different size babies.

Other devices disclose the use of VELCRO as a means of converting garments from one form to another form. U.S. Pat. No. 4,006,495 to Jones discloses an adult's coat garment that has a semi-detachable sleeve wherein a coat can be converted to a vest. The sleeves of Jones, however, are merely detachable, no means of providing adjustment for growth is provided.

U.S. Pat. No. 4,104,742 to Rahaim discloses an adult's convertible short pants and skirt garment that uses VELCRO as a means of temporarily securing the garment in various configurations. In particular this garment is made so as to function as a skirt in one configuration and a pair of shorts with a crotch in the second configuration. Again, as with the Jones patent there is no provision for adjustments to be made to accommodate human growth for various sizes.

U.S. Pat. No. 4,718,122 to Steverson discloses an adult convertible garment wherein a raincoat can be converted to a car length coat or a coat may be converted to a coverall garment. The principal means of connecting the various parts of the convertible garment are VELCRO connectors. As with other prior art garments, this garment lacks the adjustment characteristic of the present invention.

U.S. Pat. No. 4,639,946 to Koenig discloses a child restraining garment with a detachable bib. The purpose of the garment is to secure a small child or infant to a high chair while the child is eating. The Koenig garment uses VELCRO as a means of providing child restraint but fails to provide the degree of adjustability required for child growth that the present invention provides.

Aside from adjustability, the present invention offers many other advantages over the prior art. Because of the extensive use of hook and loop type connectors, the use of snaps and zippers is minimized or eliminated. Snaps and zippers can cause injuries to small children or infants because the children have a tendency to tamper with them. Children may also attempt to tamper with a standard VELCRO connection. The present invention inhibits such tampering by providing a shield piece over the VELCRO fastening to prevent children from dismantling the clothing. The locations of the VELCRO fittings also limit the child's ability to tamper with the clothing. For example, the shoulder adjustment of the present invention is located in front at a location that is difficult for the infant to reach. Likewise the leg adjustments of the present invention are located in back to make it difficult for the child to tamper with the adjustments.

The use of VELCRO also facilitates the attachment of accessories to children's clothing. Examples of these accessory attachments are removable bib attached to the front of the jumpsuit and a removable hood that can be attached to the back of the jumpsuit. In this embodiment, the connection provides for a more secure fastener. Additionally, gloves and boots can be attached by VELCRO means to the ends of the arms or legs of the basic jumpsuit. The legs of the jumpsuit can also be provided with a VELCRO inseam to provide easy access to an infant's diaper.

SUMMARY OF THE INVENTION

An improved adjustable garment according to one embodiment of the present invention comprises a first and second panel with means for adjustably connecting the panels. The adjustable connecting means includes a first flap connected to the first panel having a surface with a plurality of hook type connectors disposed thereon, a second flap connected to the second panel having an inwardly facing surface and an outwardly facing surface wherein the inwardly facing surface has a plurality of loop type connectors displaced thereon for removable engagement with the first flap surface, and a cover flap connected to the first panel having a connecting region with a plurality of loop type connectors displaced thereon for removable engagement with the first flap surface.

Another feature of the present invention is the combination of the before mentioned connecting means with elastic means disposed about the periphery of an opening in the garment. Yet another feature of the present invention is a children's garment covering the upper portion of the child's body that has shoulder strap adjusting means of the type described above. A further feature of the present invention is a children's garment that covers the lower portion of the child's body and includes adjustment means to adjust the size of the opening for the child's leg the adjustment means being of the type described above including flap connection means and elastic.

It is an object of the present invention to provide a new and improved adjustable garment. Another object of the present invention is to provide a children's garment that may accommodate various human growth periods. Related objects and advantages of the present invention will be apparent from the following description.

DESCRIPTION OF THE PREFERRED EMBODIMENT

Figure 1:
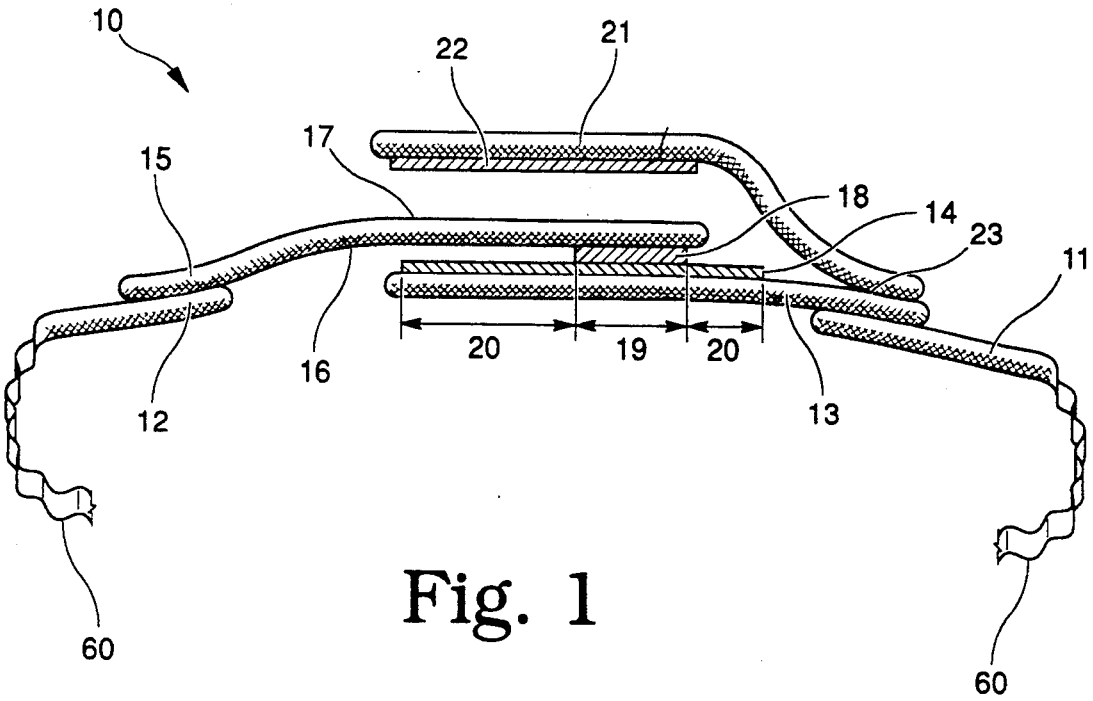
FIG. 1 is a side view of the preferred embodiment of the adjustable fastening system incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
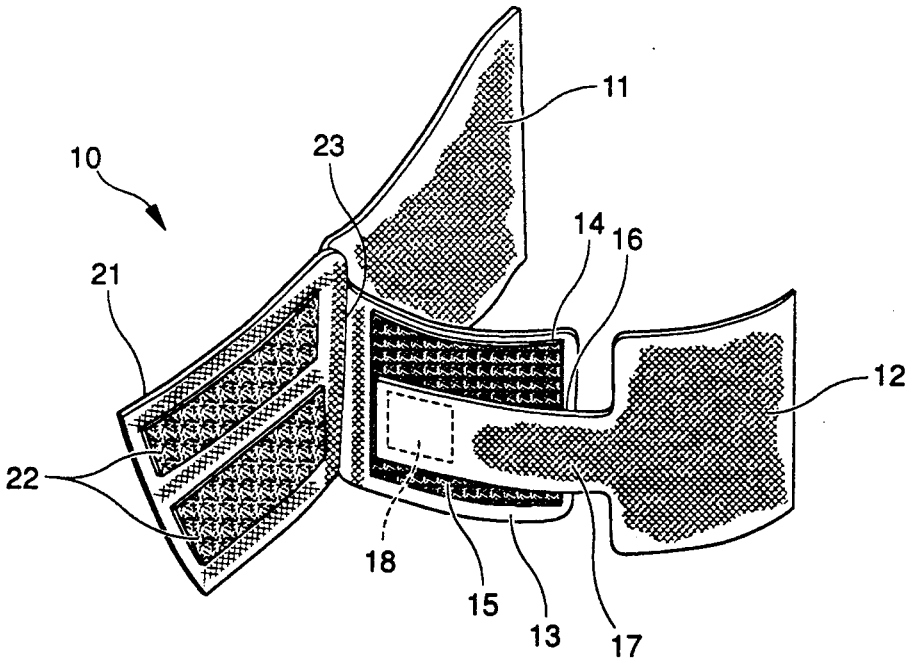
FIG. 2 is a perspective view of the preferred embodiment of the adjustable fastening system incorporating the present invention.

Now referring more particularly to FIGS. 1 and 2 there is shown an adjustable garment fitting 10. The purpose of the fitting is to provide a means of adjustably connecting the first clothing panel 11 to second clothing panel 12. First flap 13 is connected to first panel 11 by any one of a number of ways known in the art for connecting one fabric to another fabric. These ways would include either stitching or gluing the pieces together. In the preferred embodiment of the invention this flap and other flaps are made of fabric similar to the fabric that the garment is made of. On the upper side of first flap 13 is a connector surface 14. This surface is composed of a plurality of hook type connectors of the VELCRO or hook and loop type material.

A second flap 15 is likewise connected to second panel 12. This flap has an inwardly facing surface 16 and outwardly facing surface 17. A portion of the inwardly facing surface 16 is covered with loop type connectors of the VELCRO type. This loop type connector surface 18 engages the hook type connector surface 14 at the first region 19 of the hook type connector surface 14.

The first region 19 is defined by this point of connection. The first region 19 may be disposed at any given point along the hook type connector surface 14 depending upon the amount of adjustment required to size the garment. The remainder of the hook type connector surface 14 that is not engaged to the loop type connector surface 18 comprises a second region 20.

A cover flap 21 is also connected to first panel 11. In the preferred embodiment of the invention cover flap 21 is connected to first panel 11 in such a way as to form a hinged type arrangement 23 between the first flap 13 and the cover flap 21. The cover flap 21 can also be connected directly to first flap 13 as shown in FIG. 1.

The cover flap has an inwardly facing connecting region 22 that is composed of a plurality of loop type connectors. The cover flap 21 is shown in FIGS. 1 and 2 as it would be just prior to engagement with first flap 13. After the proper adjustment has been made between the first flap 13 and the second flap 15 the connecting region 22 of cover flap 21 is engaged with second region 20 of first flap 13 with second flap 15 being disposed between the first flap 13 and cover flap 21. In the preferred embodiment of the invention as shown in FIG. 2 the second flap 15 is somewhat narrower than both the first flap 13 and the cover flap 21 to allow for an effective engagement of the hook type connector surface 14 of first flap 13 and the loop type inwardly facing connecting region 22 of cover flap 21.

Figure 3:
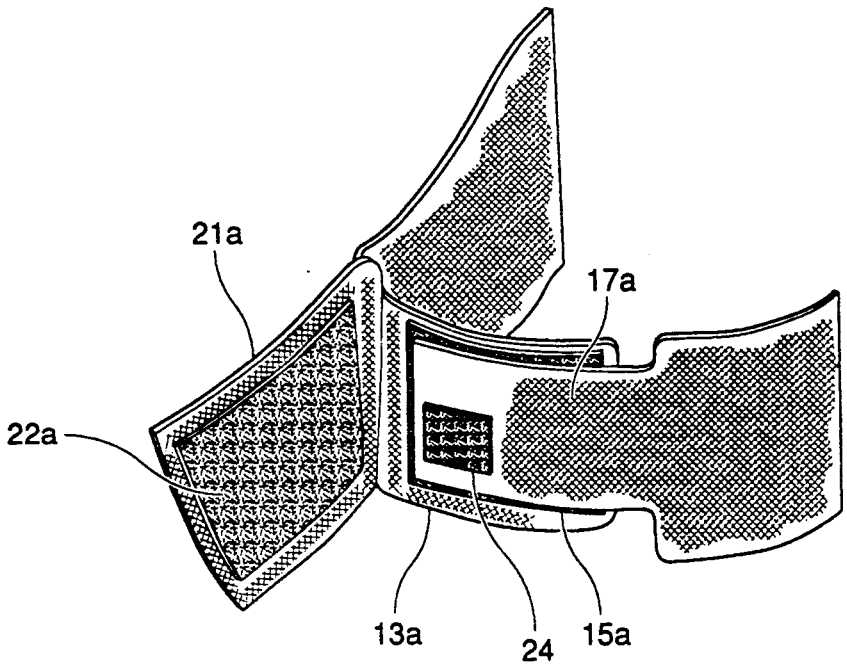
FIG. 3 is a perspective view of an alternate embodiment of the adjustable fastening system incorporating the present invention.

It is also noted that in an alternate embodiment of the invention a portion of hook type connectors could be disposed on the outwardly facing surface 17 of the second flap 15 to further secure the cover flap 21 over second flap 15. Such an arrangement is shown in FIG. 3. In this figure, hook type connector surface 24 on outwardly facing surface **17*a* of second flap 15*a* engages inwardly facing connecting region 22*a* of cover flap 21*a***. Connection in this manner provides for a more secure fastener.

Figure 5:
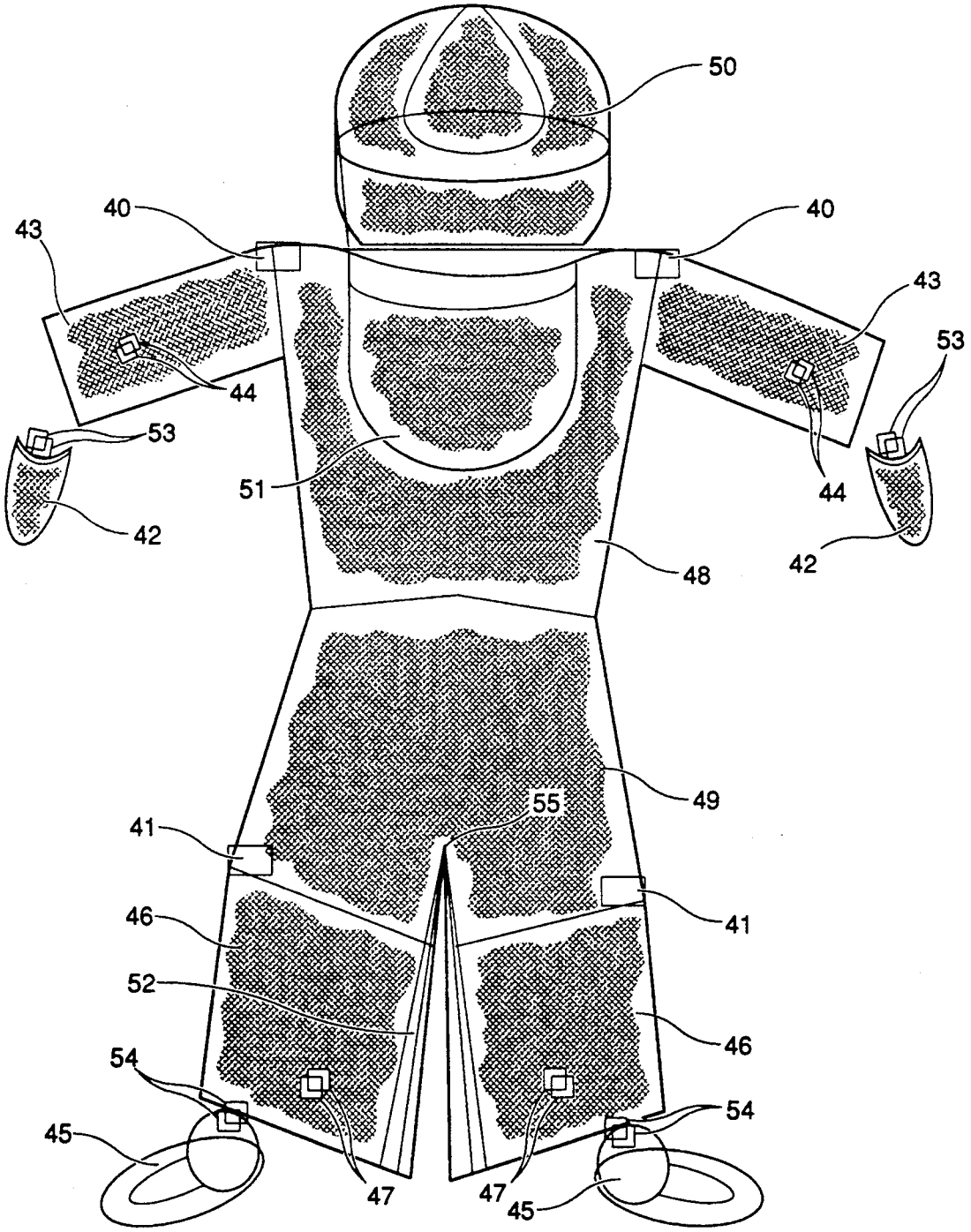
FIG. 5 is a frontal view of a children's garment incorporating the present invention.

The type of fastener shown in FIG. 3 can be used at mitten attachment locations 44 and booty attachment locations 47 as shown in FIG. 5. Each mitten 42 or booty 45 would employ two of the second flaps **15*a*. These flaps are located at mitten flap locations 53 and booty flap locations 54. The corresponding first flaps 13*a* and cover flaps 21*a* are located at mitten attachment locations 44 and booty attachment locations 47**.

Figure 4:
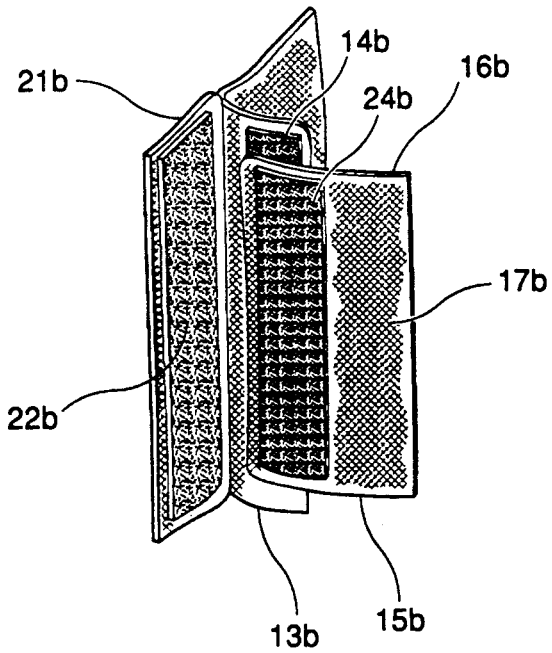
FIG. 4 is a perspective view of an alternate embodiment of the adjustable fastening system incorporating the present invention.

Another embodiment of the present invention as illustrated in FIG. 4 can be used at crotch location 55 shown in FIG. 5. In this embodiment, the first flap **13*b*, second flap 15*b*, and cover flap 21*b* are wider than their length. Second flap 15*b* has a portion of hook type connector surface 24*b* disposed on its outwardly facing surface 17*b* to engage inwardly facing connecting region 22*b* of cover flap 21*b*. Second flap 15*b* also has a portion of loop type material on its inwardly facing surface 16*b* to connect to hook type connector surface 14*b* located on first flap 13*b***. This construction of primary and secondary engagements allows easy access to the diaper area and provides for a more secure and better protected fastener.

To make an adjustment to a garment using the present invention one first peels away cover flap 21 from first flap 13, disengaging the loop type connecting region 22 from the hook type connecting surface 14. Next, second flap 15 is disengaged from first flap 13 by breaking the bond between the loop type connector surface 18 on second flap 15 and the hook type connector surface 14 on first flap 13. Second flap 12 is then moved to effect an adjustment in the size of the garment. Referring to FIG. 1, if second flap 12 were moved to the right it would tighten the garment. Likewise, moving second flap 12 to the left would loosen the garment.

After an adjustment is made, the loop type connector surface 18 of second flap 15 is reengaged to the hook type connector surface 14 of first flap 13. The loop type connecting region 22 of cover flap 21 is then engaged over the outwardly facing surface 17 of second flap 15 onto second region 20 of first flap 13. The use of the cover flap in this manner protects the connection between the first and second flap and prohibits young children from disconnecting the adjustor.

In an alternate embodiment of the present invention, garment fitting 10 is used in combination with an elastic band 60. This garment fitting is for use about an arm or leg. The fitting is comprised of an adjustable garment fitting 10 as described in FIG. 1 in combination with an elastic band 60 sewn into panels 11 and 12. The adjustable fitting and the elastic band 60 define an opening for an appendage. The elastic band 60 effectively prevents the arm or leg portion of a children's garment from riding up the child's leg or arm. The adjustable fitting makes it possible to adjust the opening size to accommodate the child's growth.

FIG. 5 shows various locations where the adjustable fitting may be used in a small child's garment. The preferred embodiment location for the type of fitting shown in FIG. 1 is for shoulder straps 40 as shown in FIG. 5. The location for the use of an alternate embodiment elastic band fitting is shown in FIG. 5 at the lower thighs 41 of an infant's jumpsuit.

The fitting of the present invention is also used in attaching accessories to the children's jumpsuit. Hook and loop type connectors are employed in the present invention to attach a hood 50 to the back portion of the upper torso region 48. A bib 51 can be removably attached to the front of the upper torso region 48 by hook and loop connectors. A further use of hook and loop connectors is shown along the interior portion of the legs 46 and the lower body region 49. This use of hook and loop connectors is to provide easy access to an infant's diaper.

Provisions can be made in the jumpsuit to allow the arms 43 to be attached to the torso region 48 with hook and loop connectors so that the arms may be removed from the jumpsuit. Likewise legs 46 may be attached to lower body region 49 with hook and loop type connectors to provide for removal of the legs 46.

Provisions can be made in the jumpsuit to allow permanent attachment of arms 43 to torso 48 and legs 46 to lower body 49. These provisions allow for a broad range of garment styles.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An adjustable garment comprising:

a first panel;

a second panel;

means for adjustably connecting said first and second panels including;

a first flap, connected to said first panel, wherein said first flap has a surface with a plurality of hook-type connectors disposed thereon, said surface having a first region and a second region;

a second flap connected to said second panel, wherein said second flap has an inwardly facing surface and an outwardly facing surface wherein said inwardly facing surface has a plurality of loop-type connectors displaced thereon for removable engagement with said first region of said first flap surface; and a cover flap connected to said first panel, wherein said cover flap has a connecting region substantially coextensive with said first region of said first flap surface, said connecting region also having a surface with a plurality of loop-type connectors displaced thereon for removable engagement with said second region of said first flap surface;

wherein said second flap means are removably attachable to said first flap means and said third flap means are removably attachable to said first flap means over said second flap means.

2. The garment of claim 1, wherein said first flap and said cover flap have ends which are joined to said first panel so as to form a hinge between said first flap and said cover flap.

3. A garment fitting comprising:

a garment having an opening for an appendage elastic means disposed about the periphery of said opening means for adjusting the diameter of said opening including;

a break in the periphery of said opening defining a first side of said opening and a second side of said opening; and a first flap, connected to said first side of said opening, wherein said first flap has a surface with a plurality of hook-type connectors disposed thereon, said surface having a first region and a second region;

a second flap, connected to said second side of said opening, wherein said second flap has an inwardly facing surface and an outwardly facing surface wherein said inwardly facing surface has a plurality of loop-type connectors displaced thereon for removable engagement with said first region of said first flap surface; and a cover flap, connected to said first side of said opening, wherein said cover flap has a connecting region substantially coextensive with said first region of said first flap surface, said connecting region also having a surface with a plurality of loop-type connectors displaced thereon for removable engagement with said second region of said first flap surface;

wherein said second flap means are removably attachable to said first flap means and said third flap means are removably attachable to said first flap means over said second flap means.

4. A children's garment comprising:

torso covering means including;

a first panel;

a second panel;

shoulder strap means for adjustable connecting said first and second panels including;

a first flap, connected to said first panel, wherein said first flap has a surface with a plurality of hook-type connectors disposed thereon, said surface having a first region and a second region;

a second flap, connected to said second panel, wherein said second flap has an inwardly facing surface and an outwardly facing surface wherein said inwardly facing surface has a plurality of loop-type connectors displaced thereon for removable engagement with said first region of said first flap surface; and a cover flap, connected to said first panel, wherein said cover flap has a connecting region substantially coextensive with said first region of said first flap surface, said connecting region also having a surface with a plurality of loop-type connectors displaced thereon for removable engagement with said second region of said first flap surface;

wherein said second flap means are removably attachable to said first flap means and said third flap means are removably attachable to said first flap means over said second flap means.

5. The garment of claim 4 wherein said torso covering means includes:

a body with apertures for the child's arms;

arm covering means having a hand end and a shoulder end;

means for adjustably connecting said body to said arm covering means including;

a portion of hook-type fabric of the hook-and-loop securement type adhered to said body about said aperture;

a portion of loop-type fabric of the hook-and-loop securement type adhered about said shoulder end of said arm covering means; and said loop-type fabric is removably engageable to said hook-type fabric to adjustably connect said arm covering means to said body.

6. The garment of claim 5 wherein said hand end of said arm covering means includes means of adjustably connecting said arm end to hand covering means including;

a first flap, connected to said arm covering means, wherein said first flap has a surface with a plurality of hook-type connectors disposed thereon, said surface having a first region and a second region;

a second flap, connected to said hand covering means, wherein said second flap has an inwardly facing surface and an outwardly facing surface; wherein said inwardly facing surface has a plurality of loop-type connectors displaced thereon for removable engagement with said first region of said first flap surface; and a cover flap, connected to said arm covering means, wherein said cover flap has a connecting region substantially coextensive with said first region of said first flap surface, said connecting region also having a surface with a plurality of loop-type connectors displaced thereon for removable engagement with said second region of said first flap surface;

wherein said second flap means are removably attachable to said first flap means and said third flap means are removably attachable to said first flap means over said second flap means.

7. A children's garment comprising:

lower body covering means including;

a first panel;

a second panel;

means for adjustable connecting said first and second panels including;

crotch forming means including;

a first flap, connected to said first panel, wherein said first flap has a surface with a plurality of hook-type connectors disposed thereon;

a second flap, connected to said first panel, wherein said second flap has a surface with a plurality of loop-type connectors disposed thereon;

a third flap, connected to said second panel, wherein said third flap has an inwardly facing surface and an outwardly facing surface wherein said inwardly facing surface has a plurality of loop-type connectors displaced thereon for removable engagement with said first flap surface and said outwardly facing surface has a plurality of hook-type connectors displaced thereon for removable engagement with said second flap surface;

leg opening forming means including;

elastic means disposed about the periphery of said opening means for adjusting the diameter of said opening including;

a break in the periphery of said opening defining a first side of said opening and a second side of said opening; and a first flap, connected to said first side of said opening, wherein said first flap has a surface with a plurality of hook-type connectors disposed thereon, said surface having a first region and a second region;

a second flap, connected to said second side of said opening, wherein said second flap has an inwardly facing surface and an outwardly facing surface wherein said inwardly facing surface has a plurality of loop-type connectors displaced thereon for removable engagement with said first region of said first flap surface; and a cover flap, connected to said first side of said opening, wherein said cover flap has a connecting region substantially coextensive with said first region of said first flap surface, said connecting region also having a surface with a plurality of loop-type connectors displaced thereon for removable engagement with said second region of said first flap surface.

8. The garment of claim 7 wherein said lower body covering means includes:

a body with apertures for the child's legs;

leg covering means having a foot end and a crotch end;

means for adjustably connecting said body to said leg covering means including;

a portion of hook-type fabric of the hook-and-loop securement type adhered to said body about said aperture;

a portion of loop-type fabric of the hook-and-loop securement type adhered about said crotch end of said leg covering means; and said loop-type fabric is removably engageable to said hook-type fabric to adjustably connect said leg covering means to said body.

9. The garment of claim 8 wherein said foot end of said leg covering means includes means of adjustably connecting said leg end to foot covering means including;

a first flap, connected to said leg covering means, wherein said first flap has a surface with a plurality of hook-type connectors disposed thereon, said surface having a first region and a second region;

a second flap, connected to said foot covering means, wherein said second flap has an inwardly facing surface and an outwardly facing surface wherein said inwardly facing surface has a plurality of loop-type connectors displaced thereon for removable engagement with said first region of said first flap surface; and a cover flap, connected to said leg covering means, wherein said cover flap has a connecting region substantially coextensive with said first region of said first flap surface, said connecting region also having a surface with a plurality of loop-type connectors displaced thereon for removable engagement with said second region of said first flap surface;

wherein said second flap means may be removably attached to said first flap means and said third flap means are removably attachable to said first flap means over said second flap means.

10. The children's garment of claim 4 further comprising:

lower body covering means including:

a first panel;

a second panel;

means for adjustably connecting said first and second panels including;

crotch forming means including;

a first flap, connected to said first panel, wherein said first flap has a surface with a plurality of hook-type connectors disposed thereon;

a second flap, connected to said first panel, wherein said second flap has a surface with a plurality of loop-type connectors disposed thereon;

a third flap, connected to said second panel, wherein said third flap has an inwardly facing surface and an outwardly facing surface wherein said inwardly facing surface has a plurality of loop-type connectors displaced thereon for removable engagement with said first flap surface and said outwardly facing surface has a plurality of hook-type connectors displaced thereon for removable engagement with said second flap surface;

leg opening forming means including;

elastic means disposed about the periphery of said opening means for adjusting the diameter of said opening including;

a break in the periphery of said opening defining a first side of said opening and a second side of said opening; and a first flap, connected to said first side of said opening, wherein said first flap has a surface with a plurality of hook-type connectors disposed thereon, said surface having a first region and a second region;

a second flap, connected to said second side of said opening, wherein said second flap has an inwardly facing surface and an outwardly facing surface wherein said inwardly facing surface has a plurality of loop-type connectors displaced thereon for removable engagement with said first region of said first flap surface; and a cover flap, connected to said first side of said opening, wherein said cover flap has a connecting region substantially coextensive with said first region of said first flap surface, said connecting region also having a surface with a plurality of loop-type connectors displaced thereon for removable engagement with said second region of said first flap surface.

* * * * *